US009068429B2

(12) United States Patent
Mailand et al.

(10) Patent No.: US 9,068,429 B2
(45) Date of Patent: Jun. 30, 2015

(54) DISSOLVABLE TOOL AND METHOD OF DISSOLVING SAME

(71) Applicants: Jason C. Mailand, The Woodlands, TX (US); Charles C. Johnson, League City, TX (US); Jeffery D. Kitzman, Conroe, TX (US)

(72) Inventors: Jason C. Mailand, The Woodlands, TX (US); Charles C. Johnson, League City, TX (US); Jeffery D. Kitzman, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 155 days.

(21) Appl. No.: 13/670,902

(22) Filed: Nov. 7, 2012

(65) Prior Publication Data

US 2014/0124214 A1 May 8, 2014

(51) Int. Cl.
*E21B 34/06* (2006.01)
*E21B 33/12* (2006.01)

(52) U.S. Cl.
CPC ..... *E21B 33/1208* (2013.01)

(58) Field of Classification Search
USPC ..... 166/376, 192
See application file for complete search history.

(56) References Cited

U.S. PATENT DOCUMENTS

| | | | | |
|---|---|---|---|---|
| 8,231,947 | B2 | 7/2012 | Vaidya et al. | |
| 2007/0181224 | A1 | 8/2007 | Marya et al. | |
| 2011/0284240 | A1 * | 11/2011 | Chen et al. | 166/373 |
| 2012/0111576 | A1 * | 5/2012 | Churchill | 166/373 |
| 2012/0118583 | A1 * | 5/2012 | Johnson et al. | 166/376 |
| 2014/0027128 | A1 * | 1/2014 | Johnson et al. | 166/376 |

OTHER PUBLICATIONS

H. Dreikhausen, "Quality Improvement of Liner Cementations by Using Bottom and Top Plugs"; SPE/IADC 21971; Mar. 11, 1991; 8 pages.

J.W. Powell et al., "Thixotropic, Crosslinking Polymer/Borate/Salt Plug; Development and Application"; Society of Petroleum Engineers, SPE Paper No. 22068; May 29, 1991; 8 pages.

* cited by examiner

*Primary Examiner* — William P Neuder
(74) *Attorney, Agent, or Firm* — Cantor Colburn LLP

(57) ABSTRACT

A dissolvable tool includes a body having at least a portion configured to dissolve in a fluid, and a barrier connected to the body. The barrier is configured to slidably fluidically seal to a structure that the body and the barrier are movable within to maintain a volume of the fluid between the barrier and the body while the barrier and the body are moved through the structure.

21 Claims, 3 Drawing Sheets

DISSOLVABLE TOOL AND METHOD OF DISSOLVING SAME

BACKGROUND

Temporarily plugging passageways through tubular systems allows operators to build pressure against the temporary plug to perform an operation. For example, the hydrocarbon recovery and carbon dioxide sequestration industries employ temporary plugs in earth formation boreholes to actuate valves, to fracture earth formations and to pump proppant or acid into earth formations. After the usefulness of the pluggage is complete it is often desirable to remove the pluggage. Intervention to drill or mill out the plug is one method commonly employed, however the time and equipment required for such intervention may be undesirable. Dissolvable plugs have been developed that do not require an intervention and many work well for their intended purpose. The industry is however, always interested in new systems and methods to improve the art of temporarily plugging tubular passageways.

BRIEF DESCRIPTION

Disclosed herein is a dissolvable tool. The tool includes a body having at least a portion configured to dissolve in a fluid, and at least one barrier connected to the body configured to slidably fluidically seal to a structure that the body and the at least one barrier are movable within to maintain a volume of the fluid between the at least one barrier and the body while the at least one barrier and the body are moved through the structure.

Further disclosed herein is a method of dissolving a tool. The method includes positioning a fluid configured to dissolve a body of the tool within a structure, positioning the body and at least one barrier attached thereto within the structure such that at least a portion of the fluid is positioned between the body and the at least one barrier, running the body and the at least one barrier through the structure, and maintaining the fluid between the body and the at least one barrier.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
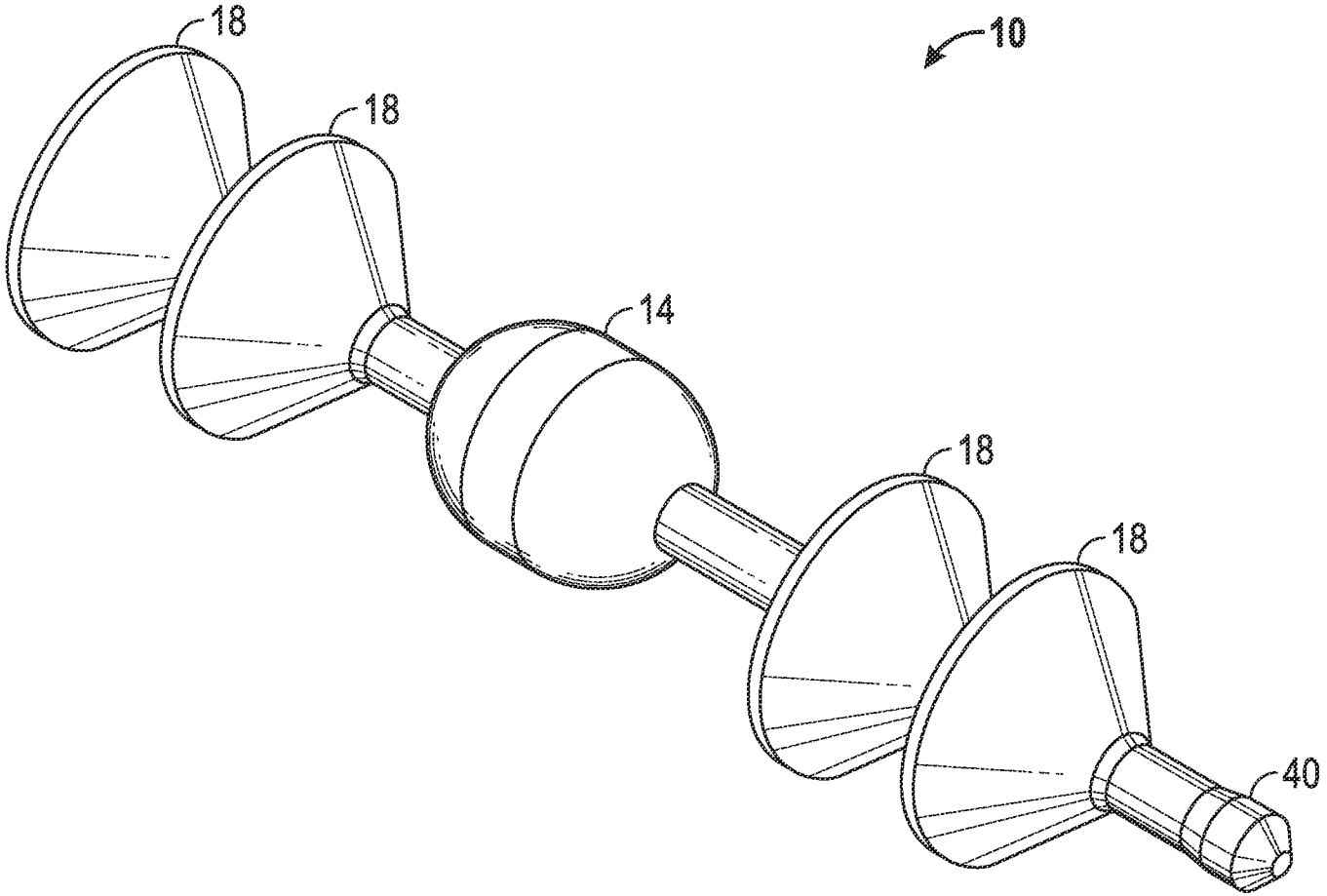
FIG. 1 depicts a perspective view of an embodiment of a dissolvable tool disclosed herein.
Figure 2:
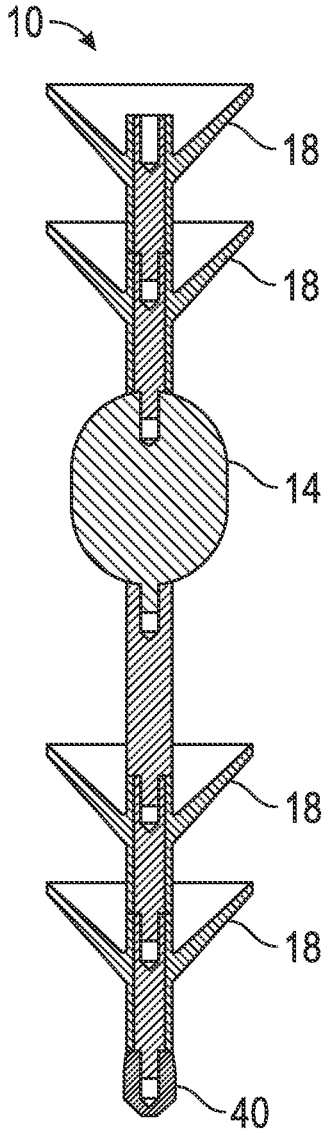
FIG. 2 depicts a cross sectional view of the dissolvable tool of FIG. 1.
Figure 3:
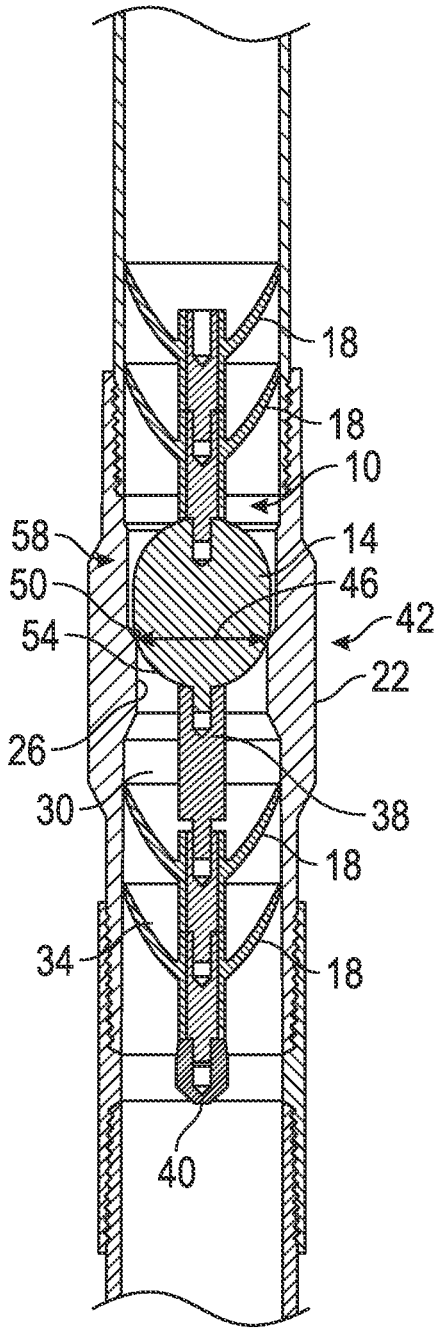
FIG. 3 depicts a cross sectional view of the dissolvable tool of FIG. 1 positioned within a structure.

Referring to FIG. 1-3, an embodiment of a dissolvable tool disclosed herein is illustrated at 10. The dissolvable tool 10 includes a body 14 and at least one barrier 18, with four of the barriers 18 being shown in the Figures. The dissolvable tool 10 is movable within a structure 22, illustrated herein as a casing or drill string in a borehole in an earth formation (FIG. 3), such as a wellbore as is commonly used in the oil and gas recovery industry, for example, or a borehole in the carbon dioxide sequestration industry. The barriers 18 are configured to slidable sealingly engage with interior walls 26 of the structure 22 while moving therethrough. This sealing maintains a volume 30 of a fluid 34 in positional relationship to the barrier 18 and the body 14 while the tool 10 is moved through the structure 22. The body 14 is made of a material dissolvable in the fluid 34. One example of such a material is disclosed in U.S. patent application Ser. No. 12/633,686 assigned to the same assignee as this application and filed on Dec. 8, 2009, the entire contents of which are incorporated herein by reference.

By maintaining the known volume 30 of the known fluid 34 the dissolvable tool 10 is a reliable and dependable configuration that provides predictable timing to dissolve the tool 10. This reliability avoids expensive downtime associated with unpredictable dissolving times of typical systems that rely on downhole fluid alone, or fluid pumped downhole but not sealably separated from existing downhole fluid, to dissolve a tool.

The dissolvable tool 10 as illustrated is constructed to allow for simple detachment and reattachment of the barriers 18 to the body 14. This configurability allows an operator to customize the tool 10 for each particular application. Such customization includes varying the number of barriers 18 positioned to either side of the body 14 as well as altering the volume 30 through use of differently sized spacers 38 that are positionable between adjacent barriers 18 or between a barrier 18 and the body 14. The spacers 38 can attach to the barriers 18 and the body 14 via the same attachment means employed between the barriers and the body 14 directly. One such common attachment means includes threadable engagement between components, for example. Altering the volume 30 may be desirable to further control the rate of dissolution of the body 14 within the fluid 34 as well as to assure that there is an adequate amount of the fluid 34 to fully dissolve the body 14. An optional nose piece 40 may be attached to one of the barriers 18 or to a spacer 38 attached to one of the barriers 18 or the body 14 directly to minimize hanging up of the tool 10 as it is run through the structure 22.

The barriers 18 can be made of the same materials as the body 14 thereby being dissolvable in the fluid 34 as well, or can be of an alternate material that is substantially non-dissolvable in the fluid 34. Regardless of the material employed, the barriers 18 may be configured to flex to allow a largest radial dimension thereof to remain in continuous contact with the interior walls 26 of the structure 22 while being run therethrough. This flexibility can allow the barriers 18 to pass through areas 42 of the structure 22 having a locally reduced radial dimension 46 without the tool 10 becoming stuck. The barriers 18 of the illustrated embodiment have a frustoconical shape when nondeformed as shown in FIGS. 1 and 2, and have a curved funnel shape when deformed as shown in FIG. 3. It should be noted that alternate barrier shapes are also employable such as disk shaped, spherical and oval, for example.

The reduced radial dimension 46 of the areas 42 may include a seat 50 configured to be seatingly engaged by the body 14 to temporarily plug the structure 22. The body 14 may have a spherical shape 54 at least on one end 58 to facilitate seatingly engaging with the seat 50. As such, the body 14 while seated at the seat 50 can allow pressure to build thereagainst to perform an operation, such as actuating another tool (not shown) or fracturing or treating an earth formation, for example. Once the body 14 has sufficiently dissolved and its largest radial dimensions reduced it can be pumped through the seat 50 thereby removing the plug without requiring an intervention and the downtime associated therewith. It should be noted that the body 14 may be sized to effectively slidably sealingly engage with the inner radial walls 26 of the structure 22 in locations other than areas 42 with the seat 50. Such a seal can aid in maintaining the fluid 34 between the barrier 18 and the body 14 thereby avoiding diluting the fluid 34 with other downhole fluids.

Figure 4:
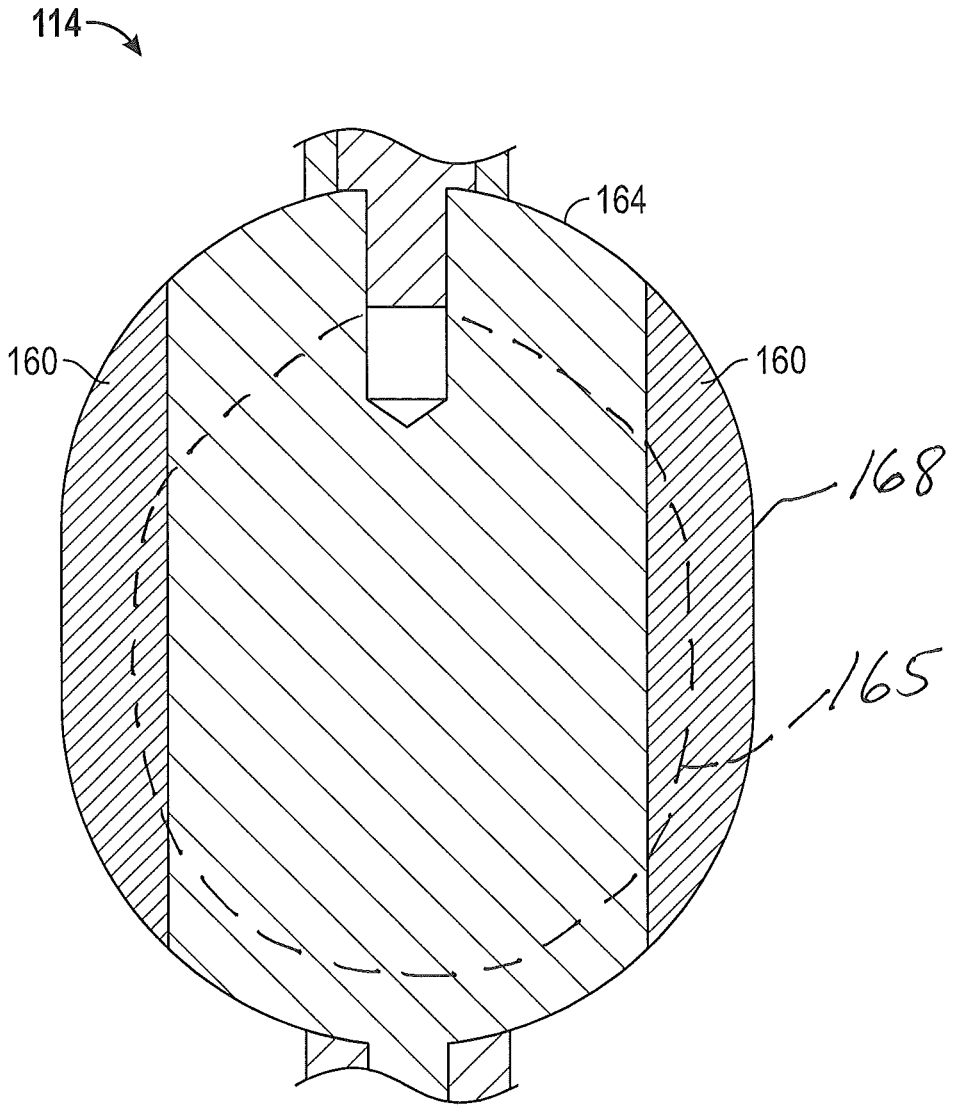
FIG. 4 depicts a cross sectional view of an alternate body employable in a dissolvable tool disclosed herein.

Referring to FIG. 4, an alternate embodiment of a body 114 usable in the tool 10 is illustrated. The body 114 differs from the body 14 in that only a portion 160, that surrounds a core 164, is dissolvable in the fluid 34. By locating the portion 160 at the largest radial dimension only of the body 114 a sufficient reduction in size of the body 114 will occur to allow the body 114 to pass through the seat 50 after dissolving has occurred. Other alternate embodiments of a body of the tool 10 are also contemplated. For example, the body 114 could be hollow such that only a shell 168 thereof is made of a solid dissolvable material while an inside (the volume inside the dashed line 165), for example, is filled with a fluid.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A dissolvable tool comprising:

a body having at least a portion configured to dissolve in a fluid; and at least one barrier connected to the body configured to slidably fluidically seal to a structure that the body and the at least one barrier are movable within to maintain a volume of the fluid between the at least one barrier and the body and thereby maintain exposure between the fluid and the at least a portion of the body configure to dissolve in the fluid while the at least one barrier and the body are moved through the structure.

2. The dissolvable tool of claim 1, wherein the structure is in a borehole in an earth formation.

3. The dissolvable tool of claim 1, wherein the body is configured to slidably sealably engage to the structure as the body moves through the structure.

4. The dissolvable tool of claim 1, wherein the at least one barrier is dissolvable in the fluid.

5. The dissolvable tool of claim 1, wherein the at least one barrier has a frustoconical shape.

6. The dissolvable tool of claim 1, wherein the at least one barrier is two barriers and each of the two barriers is located on an opposing side of the body from one another.

7. The dissolvable tool of claim 1, wherein the at least one barrier is flexible to allow the at least one barrier to deform while passing through localized dimensional reductions in an inner dimension of the structure.

8. The dissolvable tool of claim 1, wherein the at least one barrier is releasably attachable to the body.

9. The dissolvable tool of claim 1, wherein the at least one barrier is a plurality of barriers and one of the plurality of barriers is releasable attachable to another of the plurality of barriers.

10. The dissolvable tool of claim 1, wherein the at least a portion of the body has a partially spherical shape.

11. The dissolvable tool of claim 1, wherein the body is a plug capable of seating against a seat and allowing pressure built there against to actuate another tool or treat an earth formation.

12. The dissolvable tool of claim 1, wherein the volume is selected to be sufficient to completely dissolve the body.

13. The dissolvable tool of claim 1, further comprising a spacer configured to connect between the body and the at least one barrier to allow for alterations in the volume.

14. The dissolvable tool of claim 1, further comprising a nose piece configured to attached to at least one of the body and the at least one barrier to resist hanging up of the dissolvable tool as it is moved through the structure.

15. The dissolvable tool of claim 1, wherein the body is hollow.

16. The dissolvable tool of claim 1, wherein the at least one barrier is substantially non-dissolvable in the fluid.

17. A method of dissolving a tool comprising:

positioning a fluid configured to dissolve a body of the tool within a structure;

positioning the body and at least one barrier attached thereto within the structure such that a volume of the fluid is positioned between the body and the at least one barrier;

running the body and the at least one barrier through the structure; and maintaining the volume of the fluid between the body and the at least one barrier and the structure during the running;

maintaining exposure of the body to the fluid during the running; and dissolving the body with the fluid.

18. The method of dissolving a tool of claim 17, further comprising slidably sealing the at least one barrier to the structure.

19. The method of dissolving a tool of claim 17, further comprising slidably sealing the body to the structure.

20. The method of dissolving a tool of claim 17, further comprising positioning a second of the at least one barrier to the body on a side opposite that of the first of the at least one barrier.

21. The method of dissolving a tool of claim 20, further comprising maintaining the fluid between the two at least one barriers.

* * * * *